US006854390B2

(12) United States Patent
Melotti

(10) Patent No.: US 6,854,390 B2
(45) Date of Patent: Feb. 15, 2005

(54) DEVICE FOR ADJUSTING EXTRACTABLE JACKETS IN FLEXOGRAPHIC MACHINES

(75) Inventor: Renzo Melotti, Sala Monferrato (IT)

(73) Assignee: Rotomec S.p.A., San Giorgio Monferrato (IT)

( * ) Notice: Subject to any disclaimer, the term of this patent is extended or adjusted under 35 U.S.C. 154(b) by 0 days.

(21) Appl. No.: 10/755,460

(22) Filed: Jan. 13, 2004

(65) Prior Publication Data

US 2004/0139872 A1 Jul. 22, 2004

(30) Foreign Application Priority Data

Jan. 17, 2003 (IT) ..... TO2003A000020

(51) Int. Cl.[7] ..... B41F 13/10; B41F 27/06; B41F 1/10; B41F 1/16

(52) U.S. Cl. ..... 101/375; 101/376; 101/492; 101/317; 101/383; 29/895.23

(58) Field of Search ..... 101/317, 216, 101/375–376, 492, 378, 401.1, 383; 29/895.23

(56) References Cited

U.S. PATENT DOCUMENTS 3,146,709 A * 9/1964 Bass et al. ..... 101/375
4,089,265 A * 5/1978 White et al. ..... 101/375
4,119,032 A * 10/1978 Hollis ..... 101/216
4,144,812 A * 3/1979 Julian ..... 101/382.1
5,782,181 A * 7/1998 Rossini ..... 101/153
5,904,095 A * 5/1999 Nelson ..... 101/375
6,526,885 B2 * 3/2003 Walczak et al. ..... 101/375
6,742,453 B1 * 6/2004 Borski ..... 101/401.1

* cited by examiner

*Primary Examiner*—Andrew H. Hirshfeld
*Assistant Examiner*—Marissa Ferguson
(74) *Attorney, Agent, or Firm*—Young & Thompson

(57) ABSTRACT

A device in flexographic machines, for making an adjustment between an inner shaft and an extractable jacket, with the double purpose of supporting the jacket along the entire length of the shaft, and of increasing the stiffness of the jacket. The adapter comprises at each of its end portions a rigid ring, and these end rings are internally connected the one another by a first rigid cylindrical member which is thin and capable of expansion and is intended to rest against the shaft, and they are externally connected the one another by a second rigid cylindrical member intended to receive the jacket; expansion means are provided in order to secure said end rings to the shaft, and openings are provided in said second external member in order to allow blowing compressed air intended to make easier the insertion and the extraction of the jacket.

14 Claims, 1 Drawing Sheet

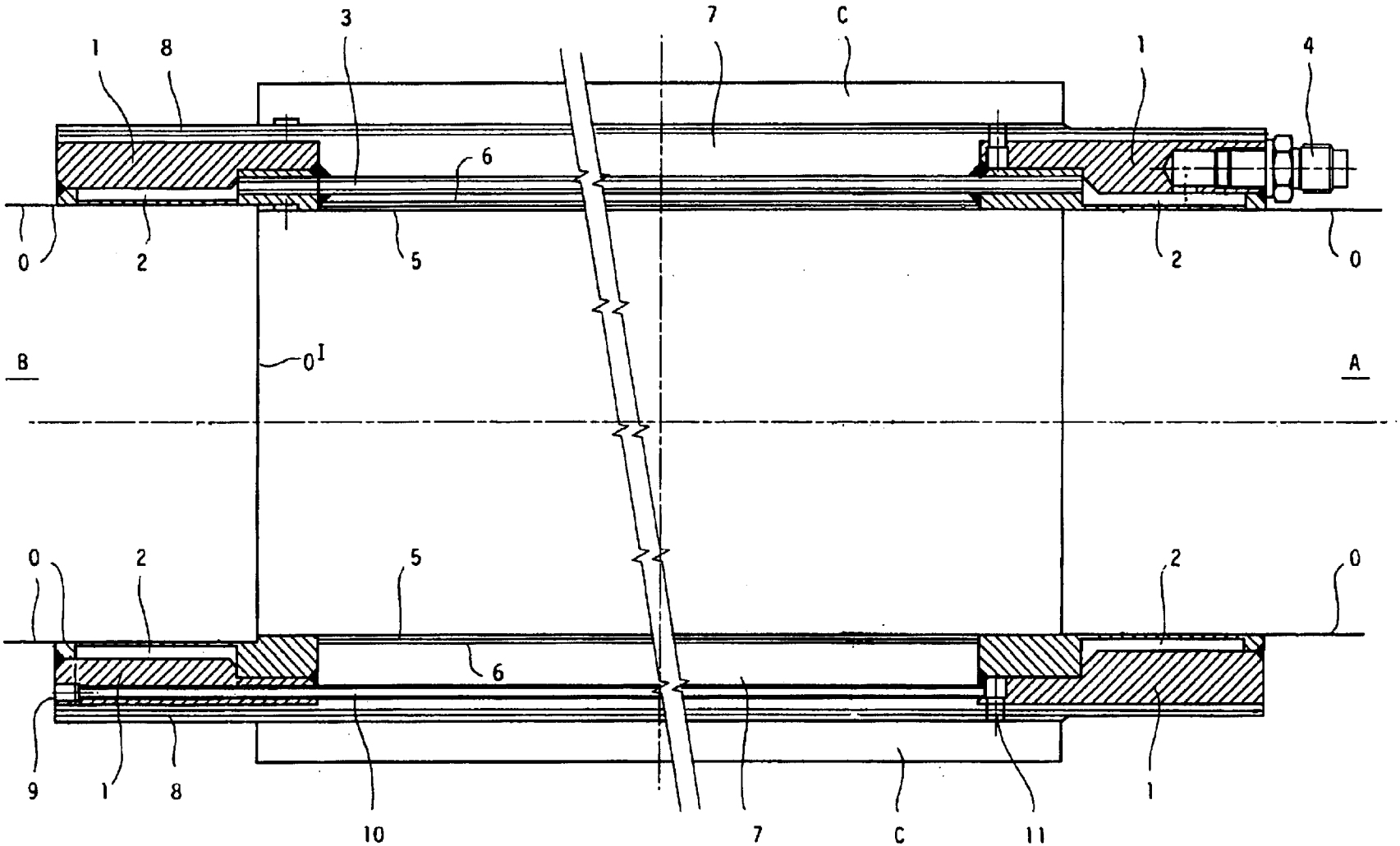
4
0
A
0
1
2
2
1
11
C
C
7
7
6
6
5
5
3
10
0
8
2
2
8
1
1
0
0
9
B

DEVICE FOR ADJUSTING EXTRACTABLE JACKETS IN FLEXOGRAPHIC MACHINES

BACKGROUND OF THE INVENTION

This invention refers to a device in flexographic machines, for making an adjustment between an inner shaft and an extractable jacket having an inner diameter larger than the outer diameter of the shaft, with the double purpose of supporting the jacket along the entire length of the shaft, and of increasing the stiffness of the jacket.

In the modern flexographic machines are often used extractable jackets on which is sticked or vulcanized the printing plate. Thanks to these jackets, a change of the subject to be printed may be effected in a few minutes. In order to ensure a perfect adhesion between the jacket and the supporting shaft (the so called mandrel), the jackets are manufactured with an inner diameter slightly smaller than the outer diameter of the mandrel, in order to provide an assemblage with interference. The operations for inserting and extracting the jacket are made easier by blowing compressed air between the mandrel and the jacket, whereby the jacket dilates and an air cushion is provided between both parts.

When, as it often happens in the printing machines for flexible packings, it is needed that the print size (and therefore the outer diameter of the jacket) is modified, jackets having different thickness are used. However, the only modification of the jacket thickness allows covering only a limited field of print size modifications. When a larger print size modification is required, use is made of a jacket having a larger diameter, and an adapter is introduced between the mandrel and the jacket. The presently known adapters may be of two different types: (1) adapters mounted with interference by means of an air cushion; and (2) adapters blocked at their end portions by means of hydraulic expansion of the shaft.

An adapter of the type (1) should be manufactured with a relatively elastic material (usually a plastic matter) in order to allow its dilation under action of the pneumatic pressure. This kind of adapter has the advantage of ensuring a close contact along the entire length, both between the mandrel and the adapter and between the adapter and the jacket, but, being elastic, it has the drawback that it cannot contribute to the stiffening of the mandrel, as it would be highly desirable.

An adapter of the type (2) is manufactured with a stiff material (for example, steel and carbon fiber) and it is rigidly connected to the mandrel at its end portions, whereby it contributes to the stiffening of the mandrel. However this type of adapter has the drawback that, in its central region, it does not rest against the mandrel, whereby the jacket carrying the print plate is not well supported in its central region and therefore, under the print pressure, it can give rise to troublesome flexions and vibrations.

SUMMARY OF THE INVENTION

The present invention has the purpose of providing an adapter which joins together the advantages of both the known types of adapters by eliminating their disadvantages.

More particularly, the invention has the double purpose of allowing supporting the jacket along its entire length and of increasing the stiffness of the shaft, thus improving the results of the print operation.

The adapter according to the invention comprises at each of its end portions a rigid ring, and these end rings are internally connected the one another by a first rigid cylindrical member which is thin and capable of expansion and is intended to rest against the shaft, and they are externally connected the one another by a second rigid cylindrical member intended to receive the jacket; expansion means are provided in order to secure said end rings to the shaft, and openings are provided in said second external member in order to allow blowing compressed air intended to make easier the insertion and the extraction of the jacket.

In this way, the adapter has a structure which is solid and light enough, and it is provided with two different means for securing the same to the shaft, namely: by elastic interference in the central region of the shaft, after the pneumatic expansion of the first inner member, operated for its insertion, and by mechanical expansion of the end rings, at the end portions of the adapter. Both these securing means allow by their cooperation to increase the stiffness of the whole comprising the shaft, the adapter and the jacket.

Preferably, said first internal member which is rigid but thin and capable of expansion is backed up by an elastic material layer capable of being compressed, which allows the dilation of the inner rigid member.

Preferably, between said first inner rigid member intended to rest against the shaft, and said second external rigid member intended to support the jacket, there is inserted a filling of rigid and light material.

Preferably, each end ring is provided with an inner chamber capable of expansion, for securing the ring to the shaft.

As an alternative, a chamber capable of expansion may be provided in the shaft in register with each end ring of the adapter, for securing the same to the shaft.

Preferably, said chamber capable of expansion is expanded by the introduction therein of a fluid under pressure.

When said chambers capable of expansion are provided in the end rings of the adapter, it is of advantage that they are connected the one another by a tube extending longitudinally along the adapter, and one of the end rings has a valve for the introduction of a fluid under pressure.

As an alternative, said chamber capable of expansion may be expanded by mechanical means suitable for compressing a fluid which fills the inner space of the chamber.

Preferably, said end rings are made of stainless steel or other suitable material, said first inner rigid member capable of expansion is made of glass fiber, metal or other suitable material having a reduced thickness, said filling is formed by a rigid and light material such as a rigid polyurethane foam, and said second external member is formed by carbon fiber and is covered by a protecting material, such as nickel or other suitable material.

BRIEF DESCRIPTION OF THE DRAWING

These and other features, objects and advantages of the subject of this invention will appear more clearly from the following description of an embodiment being a non-limiting example, with reference to the appended drawing, wherein the sole FIGURE represents a longitudinal cross section of an adapter according to the invention, mounted on a shaft and supporting a jacket.

DESCRIPTIONS OF THE PREFERRED EMBODIMENT

With reference to the embodiment shown in the drawing, number 0 designates a shaft or mandrel, which is provided with a shoulder 0' determining the exact mounting position of a jacket or adapter. As usual, shaft 0 is provided with pneumatic means (not shown) for blowing compressed air intended to dilate a jacket or adapter in order to make easier its insertion or extraction. Reference A designates the side where an operator is situated, and reference B designates the side where is installed a transmission mechanism (not shown) operating the shaft. Reference C designates a jacket having an inner diameter larger than the outer diameter of shaft 0, whereby use of an adapter is needed for mounting this jacket onto this shaft.

The adapter of the invention comprises at its end portions two rings 1 of metal material, for example made of stainless steel or other suitable material. Each end ring 1 has in its inner portion a chamber 2 that may be expanded by means of a suitable fluid under pressure, such as for example oil fat, gel or gas. This fluid under pressure is introduced in the chambers 2 through an inflating valve 4 mounted on the ring 1 situated at the side A of the operator. Both chambers 2 capable of expansion are connected the one another by a metal tube 3 allowing passage of the fluid used as the expansion means. These chambers capable of expansion have the task of operating a mechanical action blocking the end rings 1 of the adapter to the shaft 0.

Both end rings 1 are mutually connected by a first inner cylindrical member 5 being rigid but thin and capable of expansion. The first inner member 5 may be made of glass fiber, metal or other suitable material having a reduced thickness. This member 5 is intended to be dilated by the pneumatic means provided, in a well known manner, in the shaft, for blowing compressed air intended to dilate a jacket or an adapter in order to make easier its insertion or extraction. After the insertion of the adapter, these pneumatic means are inactivated, whereby the first inner member 5 of the adapter adheres to the shaft along its entire length.

As it appears from the above, the adapter is secured to the shaft by two different blocking means, namely the end rings 1 and the first inner member 5, thus improving the stiffness of the whole.

It is of advantage that a compressible layer 6 is provided for backing the first rigid member 5 in order to allow its dilation.

Moreover, both end rings 1 are mutually connected by a second external rigid cylindrical member 8. This member 8 may be made of carbon fiber, and it is preferably covered by a protecting material, such as nickel or other suitable material. The second external rigid member 8 forms the outer surface of the adapter, onto which is intended to be inserted the jacket C.

It is of advantage that a rigid and light filling material 7 is inserted between the first inner member 5 and compressible layer 6, and the second external member 8. The filling material 7 may be formed, as an example, by a rigid polyurethane foam.

In order to make easier the insertion and the extraction of the jacket C on the outer surface 8 of the adapter, the second external rigid member 8 is provided with openings 11, through which compressed air may be blown. The compressed air arrives from a pneumatic connection channel 10 ending at a pneumatic connection 9 supplying compressed air.

The adapter has an insertion direction from the operator side A towards the transmission side B. For inserting (or extracting) the adapter it is needed that the inner shaft is provided with a known circuit for distributing compressed air, whereby the first member 5 and the compressible layer 6 may be expanded, thus forming an air cushion allowing the insertion (and the extraction) of the adapter.

The two end metal rings 1 have different diameters and have a gap sufficient for attaining the operating end stroke position when the adapter is inserted onto the shaft. When the adapter has attained the operating position, the pneumatic supply dilating the member 5 and the layer 6 is interrupted, and the member 5 and layer 6 return to their original configurations, thus blocking the adapter on the shaft.

Then valve 4 is connected to a pumping device which, by supplying a suitable fluid (such as oil, fat, gel, gas), causes the chambers 2 to expand and to mechanically block the adapter on the shaft. By connecting the pneumatic plant to valve 9, compressed air is supplied through the channel 10 to the openings 11 for allowing mounting a jacket onto the adapter.

The air connection for extraction of the jacket may also be effected through the mandrel, being connected to the exterior of the adapter through suitably situated openings.

It is to be understood that the invention is not limited to the described and shown exemplary embodiment. Several possible changes have been outlined during the description, and others are within the reach of those skilled in the art. For example, the expansion chambers 2 could be provided in the shaft 0, in register with the rings 1, instead of being provided within the rings. The expansion of chambers 2 could be effected, instead of introducing a fluid under pressure through valve 4, by compressing an inner fluid using mechanical means, such as a screw capable of compressing the inner fluid. The air connection for making easier the insertion and extraction of the jacket could take place through the mandrel, with an external connection through suitably situated openings.

What is claimed is:

1. An adapter for flexographic machines, intended to be inserted on an inner shaft of the machine and to receive inserted thereon an extractable jacket having an inner diameter larger than the outer diameter of the shaft and carrying a print plate, for making an adjustment between said inner shaft and said extractable jacket, having two end portions and comprising: two rigid rings, each rigid ring being situated at one of the end portions of the adapter; a first inner cylindrical member mutually connecting said end rings, said first inner member being rigid, thin and capable of expansion and being intended to rest on said shaft; a second external cylindrical member mutually connecting said end rings, said second external member being rigid, forming the outer surface of the adapter and being intended to receive a jacket inserted thereon; expansion means provided for securing said end rings to said shaft; and openings provided in said second external member for allowing blowing compressed air intended to make easier the insertion and extraction of said jacket with respect to said second esternal member.

2. An adapter as set forth in claim 1, further comprising a compressible layer, said compressible layer being made of an elastic material, backing said first inner rigid member and allowing the dilation of said first inner member.

3. An adapter as set forth in claim 1, further comprising a filling material, said filling material being made of a rigid and light material, and being inserted between said first inner member and said second external member.

4. An adapter as set forth in claim 1, wherein each said end ring comprises an inner expandable chamber forming one of said expansion means.

5. An adapter as set forth in claim 1, wherein each said end ring comprises an inner expandable chamber forming one of said expansion means, and comprising a tube mutually connecting the expandable chambers of both said end rings, and an inflating valve provided in one of said end rings.

6. An adapter as set forth in claim 1, further comprising expandable chambers provided in said shaft in register with each said end rings, said expandable chambers forming said expansion means.

7. An adapter as set forth in claim 1, further comprising expandable chambers forming said expansion means, and means for introducing in said expandable chambers a fluid under pressure.

8. An adapter as set forth in claim 1, further comprising expandable chambers forming said expansion means, a fluid filling said expandable chambers, and mechanical means capable of compressing said filling fluid.

9. An adapter as set forth in claim 1, wherein said first inner member has an elastic interference with respect to a central portion of said shaft in order to ensure a blocking action of the adapter on said shaft in addition to the blocking action of said end rings.

10. An adapter as set forth in claim 1, wherein said end rings are made of stainless steel.

11. An adapter as set forth in claim 1, wherein said first inner member is made of glass fiber.

12. An adapter as set forth in claim 1, wherein said second external member is made of carbon fiber.

13. An adapter as set forth in claim 1, wherein said second external member is made of carbon fiber, and further comprising a protecting material, such as nickel, covering said second external member.

14. An adapter as set forth in claim 1, wherein said filling material is a rigid polyurethane foam.

* * * * *